US005733138A

United States Patent [19]

Kramer

[11] Patent Number: 5,733,138

[45] Date of Patent: Mar. 31, 1998

[54] SECURING DEVICE FOR MATING ELECTRICAL CORDS

[75] Inventor: Jay R. Kramer, Phoenix, Ariz.

[73] Assignee: Ray Clark, Phoenix, Ariz.

[21] Appl. No.: 571,670

[22] Filed: Dec. 13, 1995

[51] Int. Cl.[6] ..... H01R 13/62

[52] U.S. Cl. ..... 439/369

[58] Field of Search ..... 439/369, 370, 439/371

[56] References Cited

U.S. PATENT DOCUMENTS

| | | | |
|---|---|---|---|
| 2,406,567 | 8/1946 | Schueneman | 334/75 P |
| 2,753,536 | 7/1956 | Jader | 339/75 P |
| 2,903,669 | 9/1959 | Gilman et al. | 339/75 P |
| 4,463,999 | 8/1984 | Knickerbocker | 439/369 |
| 4,690,476 | 9/1987 | Morgenrath | 439/369 |
| 4,869,683 | 9/1989 | Nelson | 439/371 |
| 4,957,450 | 9/1990 | Pioszak | 439/369 |
| 5,147,216 | 9/1992 | Shotey | 439/369 |
| 5,167,524 | 12/1992 | Falcon et al. | 439/369 |
| 5,336,107 | 8/1994 | Sheryll | 439/369 |

*Primary Examiner*—Khiem Nguyen
*Assistant Examiner*—Yong Ki Kim
*Attorney, Agent, or Firm*—David G. Rosenbaum

[57] ABSTRACT

An electrical cord connector securing device consisting of strap members, having hook and loop material affixed to the strap members to permit a first end of each strap member to be everted over a ring member and connected to a proximal end of each strap member. The strap members are connected to ring members which are engaged concentrically over the electrical cords and adjacent electrical cord plugs on the electrical cords.

10 Claims, 1 Drawing Sheet

SECURING DEVICE FOR MATING ELECTRICAL CORDS

BACKGROUND OF THE INVENTION

The present invention provides a device for securing electrical cords together. More particularly, the present invention provides a securing device for securely mating male and female electrical plugs to one another in end-to-end fashion thereby.

One of the biggest problems on a construction site is keeping your electrical cords connected. When they come apart, which is frequent, a person has to retrace the length of the line to find the break. When the cords are extended for several hundred feet, this can eat up very valuable working time.

Many workers simply tie a knot in their lines but these are not only bulky, catching on almost anything, but they are also very dangerous. People can catch their feet in them and fall or they can cause an electrical short and either shock someone or start a fire.

Using the inventive securing device is as easy as tying a knot in your cord. The device saves your cord end from pulling out at the head. The inventive securing device is streamlined so it resists the tendency to hang up on rocks, nails, wood, or corners.

The inventive securing device is streamlined, durable, and easy to install. Unlike some of the product out on the market, it won't break, crack, or wear out. Even if the snap rings were to fail, they can be obtained from any grocery or five and dime store for pennies.

SUMMARY OF THE INVENTION

My present invention is a plug and connector clamp which securely maintains a plug and connector in mating contact without any necessity for forcibly gripping their cords. The snap rings do not damage the insulation of the cords and they can be changed according to the gauge of the electrical cord being used. i.e. ½", ¾", 1¼", etc.

The inventive securing device is not susceptible to failure under vibration or sudden pulls on the cord. Its streamlined configuration reduces any tendency for it to snag on foreign objects.

DESCRIPTION OF THE PREFERRED EMBODIMENTS

Figure 1:
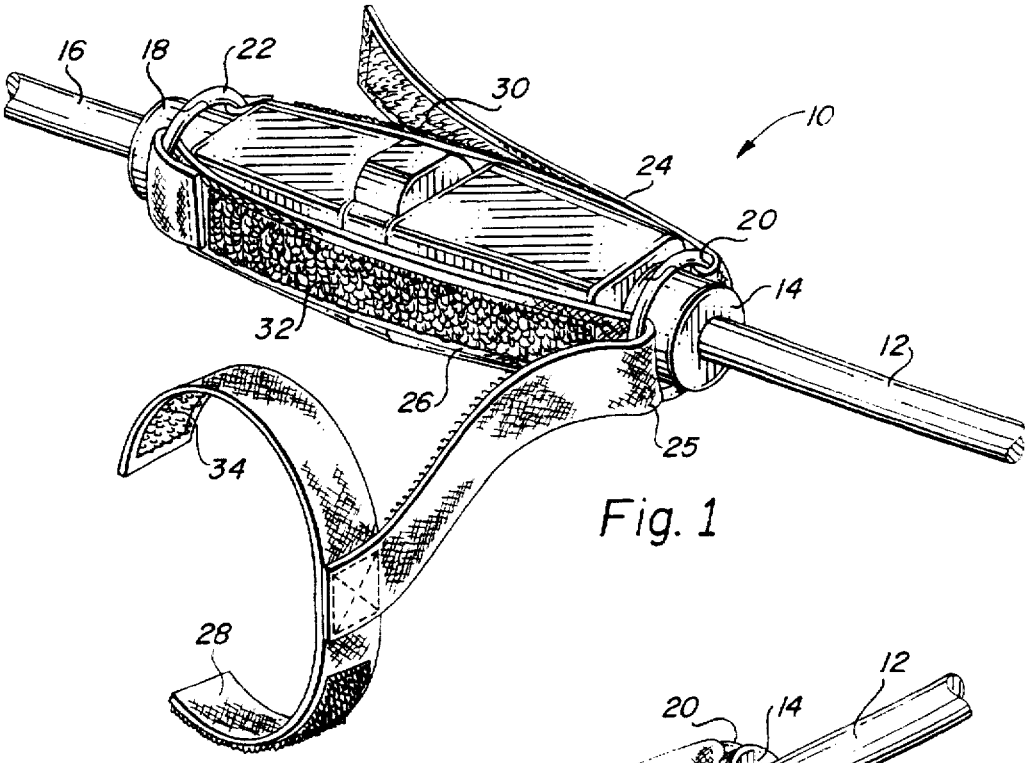
FIG. 1 is a perspective view of the securing device of the present invention illustrating the inventive securing device partially engaged about mated electrical cord plugs.
Figure 2:
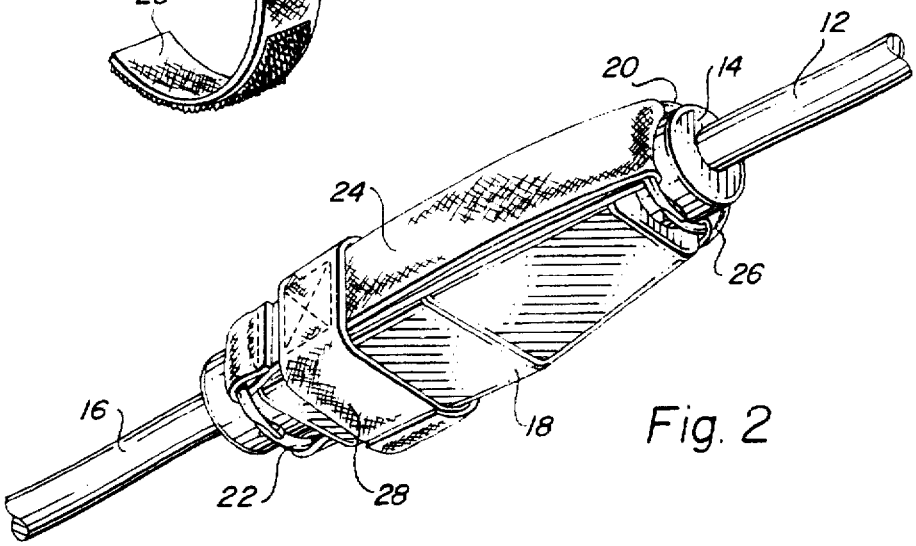
FIG. 2 is a perspective view of the securing device of the present invention illustrating the inventive securing device in a fully engaged state about mated electrical cord plugs.
Figure 3:
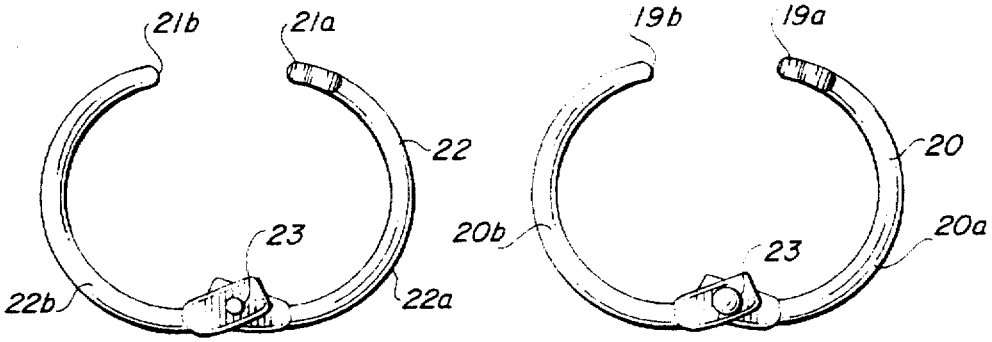
FIG. 3 is an elevational view of ring members used in the present invention.

With particular reference to the accompanying FIGS. 1–3, the securing device 10 of the present invention consists generally of a pair of ring members 20, 22, a pair of strap members 24, 26 and a plurality of hook and loop members 30, 32, 34. The strap members 24, 26 each have a proximal and distal end section onto which mating surfaces of the hook and loop members 30, 32 or 34 are attached. Pre-existing first electrical cord member 12 having a first electrical cord connector plug 14 and a second electrical cord member 16, having a second electrical cord connector plug 18 are joined together such that the first electrical cord member 12 and the second electrical cord member 16 are in a linearly opposing co-axial orientation relative to one another. The securing device 10 is coupled to the first electrical cord member 12 and the second electrical cord member 16 by engaging a first ring member 20, carrying at least one of strap members 24, 26 thereupon, concentrically about the first electrical cord member 12 and urging the first ring member 20 and the at least one of strap members 24, 26 into intimate abutting contact with a surface of the first electrical cord connector plug 14 adjacent to a juncture point between the first electrical cord 12 and the first electrical cord connector plug 14. A second ring member 20, which may carry one of strap members 24, 26 if both strap members 24, 26 are not carried upon first ring member 20, is concentrically engaged about the second electrical cord member 16 and urged into intimate abutting contact with a surface of the second electrical cord connector plug 16 adjacent to a juncture point between the second electrical cord 16 and the second electrical cord connector plug 18.

Each of the strap members 24, 26 are then passed over the first and second electrical cord connector plugs 14, 18, such that one of a proximal or distal section of each strap member 24, 26, carrying one mating surface of the hook and loop member 30, 32 is positioned in an outwardly facing orientation relative to the first and second electrical cord connector plugs 14, 18. Distal sections of each of the strap members 24, 26 are then threaded intermediate an opposing one of the ring members 20, 22 and either the first and second electrical cord connector plugs 14, 18. The distal sections of each of strap member 24, 26 is then everted over an outer peripheral surface of the opposing one of ring members 20, 22, tensioned and placed in intimate, abutting, co-planar contact with the proximal section of the same strap member 24, 26 such that the mating surfaces of the hook and loop members 30, 32 carried on the proximal and distal sections of each of strap members 24, 26 are interfaced with one another to secure the proximal and distal sections of each of strap members 24, 26 to one another. It is preferable that each of the strap members 24, 26 be positioned in diametric opposition to one another in order to more fully secure the mating of the first and second electrical cord connector plugs 14, 18.

To facilitate attachment of each of strap members 24, 26 to a ring member 20, 22, it is desirable to include a loop 25 at an end of each of strap members 24, 26, through which the ring member 20, 22 may be passed to secure the strap members 24, 26 to the ring member 20, 22. Loop 25 is preferably fashioned by everting an end of a strap member 24, 26 over onto the strap member and affixing the everted end to the strap member 24, 26, such as by heat welding, adhesive, stitching or riveting.

In accordance with the preferred embodiment of the present invention, and as illustrated in FIG. 3, each of the ring members 20, 22 are preferably a snap ring having opposing semicircular sections 20*a*, 20*b*, 22*a*, 22*b*, respectively, which are hingedly interconnected by a hinge 23 to allow the semicircular sections 20*a*, 20*b*, 22*a*, 22*b* to articulate with respect to one another. Additionally, each of the semicircular sections 20*a*, 20*b*, 22*a*, 22*b* preferably have interlocking ends 19*a*, 19*b*, 21*a*, 21*b*, which engage one another to secure the semicircular sections 20*a*, 20*b*, 22*a*, 22*b* to one another. Examples of these types of ring members useful with the present invention are readily available from office supply catalogs and stores as loose-leaf book rings.

It is preferable that each of the strap members 24, 26 be made of a material having sufficient material properties to withstand use at construction sites, such as woven nylon or polypropylene webbing.

Finally, in accordance with a preferred embodiment of the present invention, a third strap member 28 may be affixed to a distal end of one of the strap members 24, 26. The third strap member 28 is preferably oriented perpendicular to the longitudinal axis of the one of strap members 24, 26. For purposes of further explanation only, the third strap member 28 will be described as if it were attached only to strap member 26. Third strap member 28 is attached to the distal end of the strap member 26 and is everted over the proximal section of strap member 26, then concentrically wrapped about the mated first and second electrical connector plugs 14, 18 and encircling the first and second strap members 24, 26 in their everted and connected state, as illustrated in FIG. 2. In this manner, the inventive securing device 10 provides a secure connection for the electrical cords 10, 12 and protects the first and second electrical cord plugs 14, 18 from damage or abuse.

I claim:

1. An electrical cord securing device, comprising:

a) a first ring member concentrically engaged over a first electrical cord and positioned adjacent a first electrical cord plug;

b) a second ring member concentrically engaged over a second electrical cord and positioned adjacent a second electrical cord plug, the second electrical cord plug being interconnected to the first electrical cord plug; and c) at least one strap member having first and second end sections carrying one of a hook fabric material and a loop fabric material thereupon, the first end section of the at least one strap member being engaged to one of the first and second ring members, passing over and adjacent to interconnected first electrical cord plug and the second electrical cord plug, the second end section of the at least one strap member being everted over the second ring member and the hook fabric material of the first end section brought into intimate contact with the loop material of the first end section thereby securing the first end section and the second end section of the at least one strap member to itself and securing the interconnection of the first electrical cord plug with the second electrical cord plug.

2. The electrical cord securing device according to claim 1, wherein the first ring member and the second ring member further comprise loose-leaf book binding rings.

3. The electrical securing device according to claim 1, wherein the at least one strap member further comprises two strap members, each strap member having a loop member at one of the first and second end sections thereof, forming an aperture for receiving one of the first and second ring members.

4. The electrical securing device according to claim 3, wherein the loop member further comprises an everted portion of one of the first and second end sections of each of the two strap members.

5. The electrical securing device according to claim 4, wherein the everted portion of the loop member is affixed to the strap member by one of heat welding, stitching, and rivets.

6. The electrical securing device according to claim 3, wherein the two strap members are positioned in a diametrically opposing relationship with one another about the first and second ring members.

7. The electrical securing device according to claim 3, further comprising a third strap member connected to a second end of one of the two strap members and perpendicular to a longitudinal axis of the one of the two strap members, the third strap member having a hook and loop fabric material attached thereto to permit the third strap member to be concentrically wrapped about the interconnected first electrical cord plug and the second electrical cord plug and the two strap members.

8. The electrical securing device according to claim 7, wherein the two strap members and the third strap member further comprise a planar member made of a polymeric woven material.

9. The electrical securing device according to claim 1, wherein the first ring member and the second ring member further comprise opposing semi-circular members hingedly interconnected with one another, each opposing semi-circular members having connecting members positioned thereupon to interconnect the opposing semi-circular members.

10. A securing device for securing mated electrical cord plugs, comprising:

a) a first ring member concentrically engaged over a first electrical cord and positioned adjacent a first electrical cord plug;

b) a second ring member concentrically engaged over a second electrical cord and positioned adjacent a second electrical cord plug, the second electrical cord plug being interconnected to the first electrical cord plug;

c) two planar strap members, each planar strap member having first and second end sections, the first end section of the two planar strap members forming an everted loop through which is accommodated one of the first ring member and the second ring member, the second end section of each of the two planar strap members being everted over one of the first ring member and the second ring member and brought into intimate contact with the first end section; and d) securing means for securing the first end section and the second end section of the each of the two planar strap members to one another under axial tension along the longitudinal axis of each of the two planar strap members.

* * * * *